US006510963B1

(12) United States Patent
Walker et al.

(10) Patent No.: US 6,510,963 B1
(45) Date of Patent: Jan. 28, 2003

(54) NOVELTY DISPENSER

(75) Inventors: Ian Walker, London (GB); Brian Warnke, London (GB)

(73) Assignee: The Essential Box Company Limited of Fairway House, Forest Hill (GB)

( * ) Notice: Subject to any disclaimer, the term of this patent is extended or adjusted under 35 U.S.C. 154(b) by 99 days.

(21) Appl. No.: 09/716,243

(22) Filed: Nov. 21, 2000

(30) Foreign Application Priority Data

Jan. 6, 2000 (GB) ..... 0000200

(51) Int. Cl.[7] ..... A24F 15/04
(52) U.S. Cl. ..... 221/24; 221/255
(58) Field of Search ..... 221/24, 255, 256, 221/234, 155, 192

(56) References Cited

U.S. PATENT DOCUMENTS 2,954,143 A * 9/1960 Adams ..... 221/24

4,998,644 A * 3/1991 Pan ..... 221/24

* cited by examiner

*Primary Examiner*—Kenneth W. Noland

(74) *Attorney, Agent, or Firm*—Connolly Bove Lodge & Hutz LLP

(57) ABSTRACT

A novelty dispenser, in particular a novelty dispenser for dispensing small sweets such as jelly beans or chocolate drops. The dispenser comprises a body providing a reservoir for articles to be dispensed through an outlet formed therein. It also comprises an actuator adapted to cause movement of a moveable gate thereby allowing articles to pass through the outlet in response to an action from a user of the dispenser upon the actuator. The gate comprises at least one pivotable blade adjacent the outlet. Typically but not necessarily the blade is within the reservoir.

8 Claims, 6 Drawing Sheets

NOVELTY DISPENSER

FIELD OF THE INVENTION

The present invention relates to a novelty dispenser, in particular a novelty dispenser for dispensing small sweets such as jelly beans or chocolate drops.

BRIEF SUMMARY OF THE INVENTION

In its broadest sense, the present invention provides a dispenser for small articles such as sweets, the dispenser comprising a body providing a reservoir for articles to be dispensed through an outlet formed therein and the dispenser comprising an actuator adapted to cause movement of a movable gate thereby allowing articles to pass through the outlet in response to an action from a user of the dispenser upon the actuator. The gate comprises at least one pivotable blade adjacent the outlet. Typically but not necessarily the blade is within the reservoir.

Typically, the blade is pivotable to swing between a first position in which the blade obstructs the outlet and a second position in which the outlet is unobstructed. Alternatively, the blade slides between obstructing and non-obstructing positions. The blade is biased into a position where the outlet is obstructed.

Preferably, the dispenser further includes a receptacle into which the article is dispensed. Preferably, the dispenser further includes a scoop to lift an article dispensed into the receptacle, wherein the scoop lifts the article in response to a movement of the actuator.

Preferably, the dispenser is in the form of a human or animal figure. More preferably, the dispenser is in the form of Santa Claus wherein the receptacle is in the form of a sack and the scoop is one of Santa Claus' hands, the other hand forming a part of the actuating means.

BRIEF DESCRIPTION OF THE SEVERAL VIEWS OF THE DRAWING

The above and other aspects of the present invention will now be described in further detail with reference to the accompanying figures, in which.

DETAILED DESCRIPTION

With reference to the Figures, there is shown an embodiment of a dispenser in accordance with the present invention in the form of a novelty Santa Claus model 10 dispensing small sweets 11 into a receptacle in the form of a sack 12 from a reservoir formed within the body of the model through an outlet 13 (partially obscured) therefrom.

Figure 12:
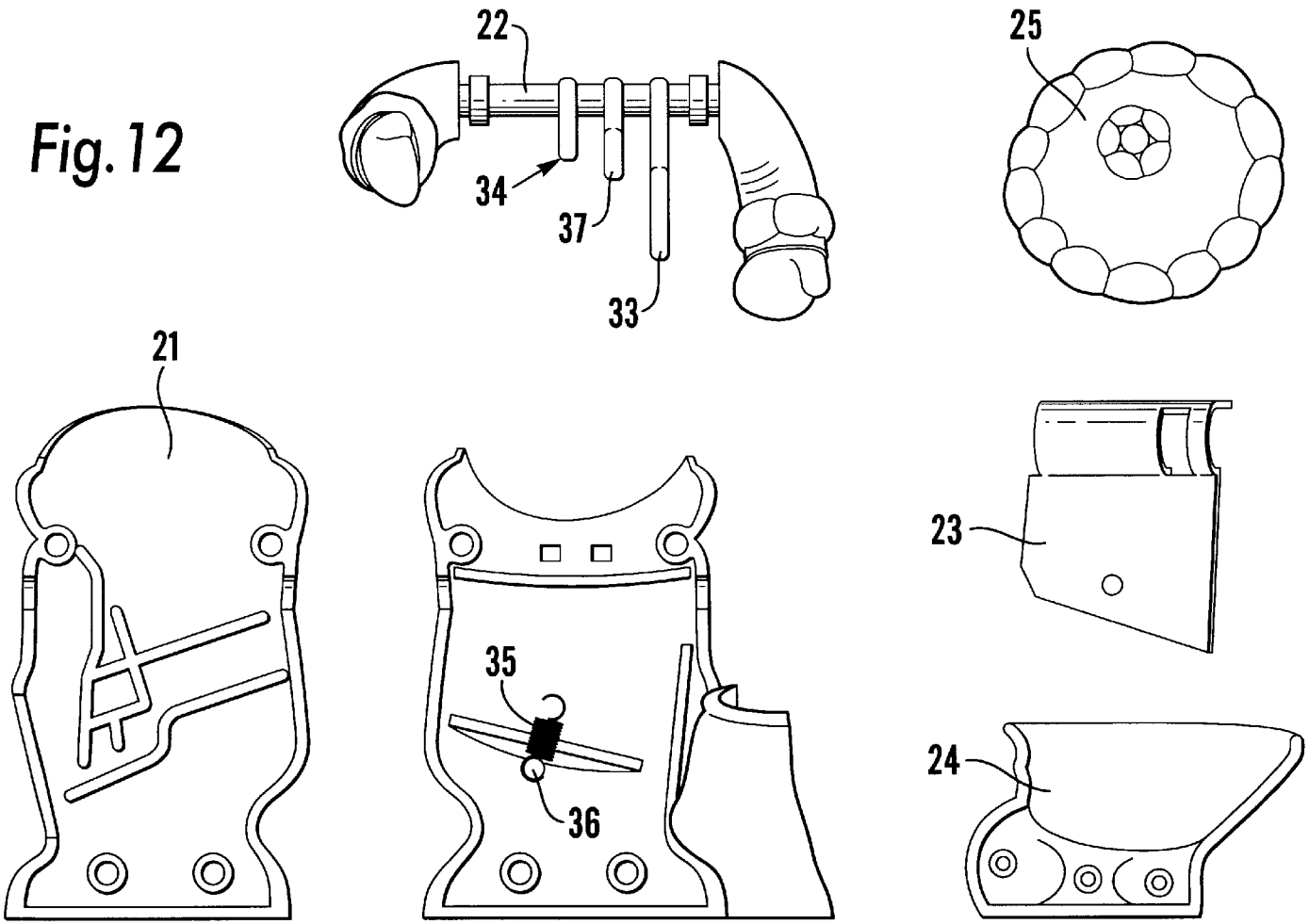
FIG. 12 shows the components from which the dispenser of FIGS. 1 to 11 may be constructed by plastics injection moulding.
Figure 13:
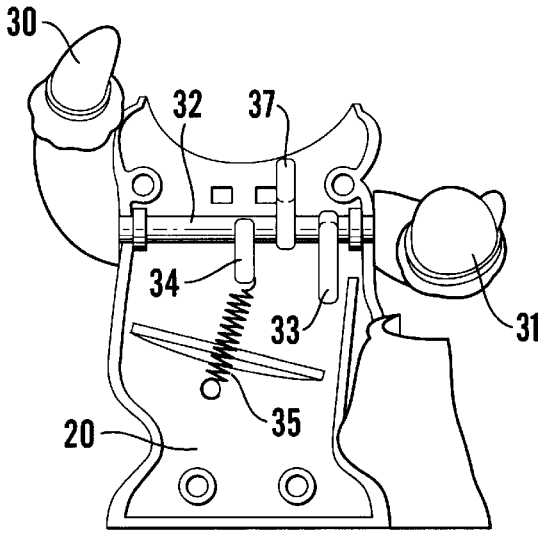
FIGS. 13 to 17 show front views of the components of FIG. 12 in various stages of assembly.
Figure 14:
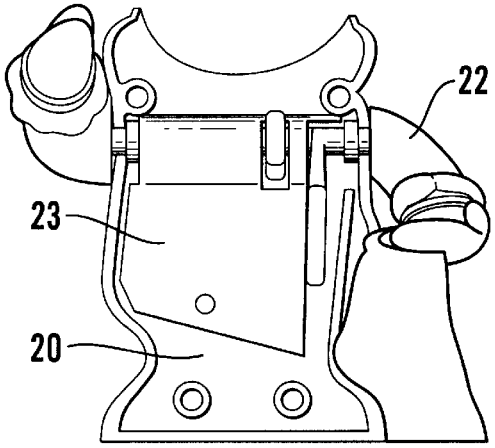

With particular reference to FIG. 12, the dispenser is formed from plastics injection moulded components, namely a main body element 20, a body cover 21, actuating means 22, reservoir back panel 23, sack component 24 and cap 25.

The actuating means 22 includes two arms 30, 31 fixedly mounted at respective ends of a rod 32. Arms 30, 31 have an angular separation in the order of 45°. Rod 32 also carries a first paddle-like blade 33 which acts to obstruct the outlet 13 which is formed, in the assembled model, between the main body element 20 and the body cover 21. The rod 32 also carries a peg 34 adapted to receive and retain one end of a spring 35, the other end of which is retained by a similar peg 36 formed in the internal surface of the main body element 20. The actuating means is designed such that the spring 35 serves to bias the actuating means into a position whereby the outlet 13 is obstructed by the first paddle-like blade 33.

Intermediate the first paddle-like blade 33 and the peg 34 is a further or second paddle-like blade 37, radially spaced from the first paddle-like blade with an angle of, typically, around 20–30°. The second paddle-like blade 37 acts to prevent more than one sweet at a time from passing into and through the outlet 13.

Figure 15:
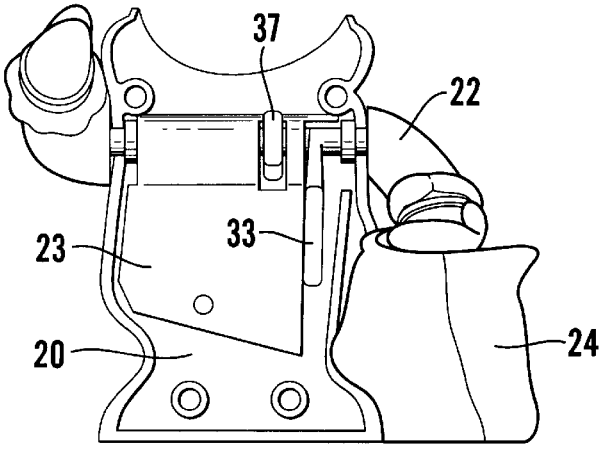
Figure 16:
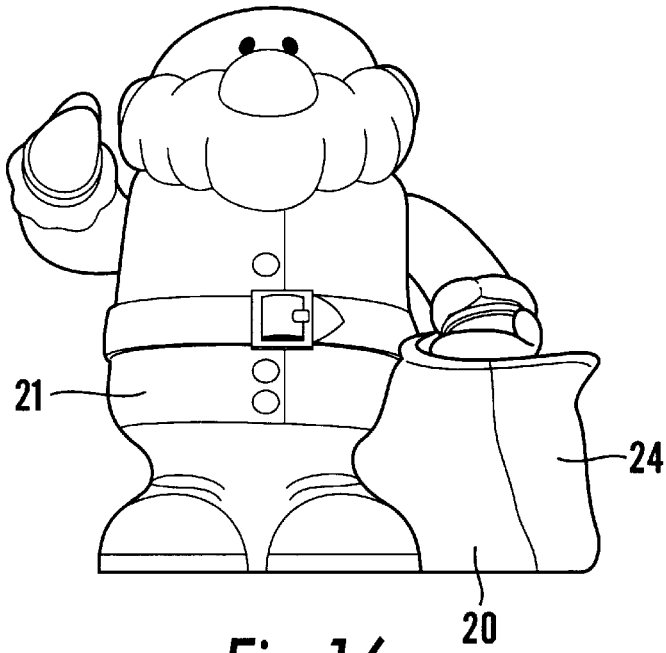
Figure 17:
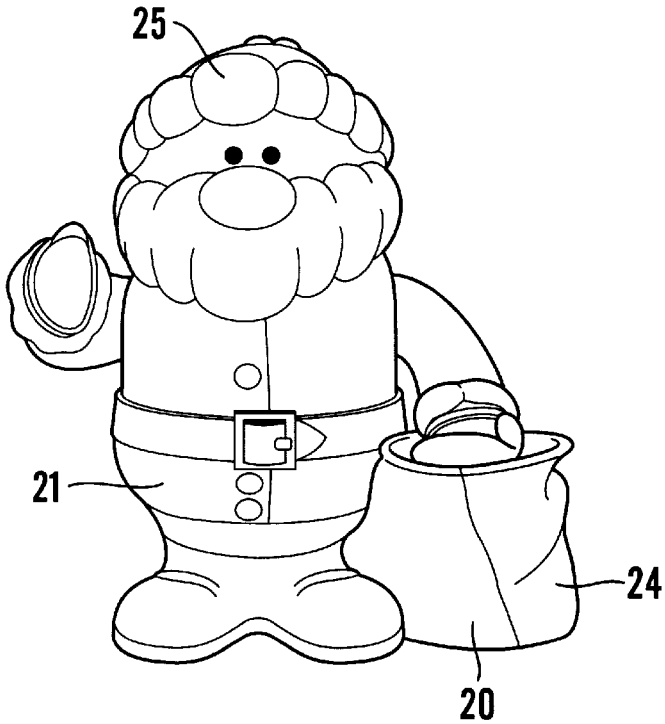

To prevent the sweets 11 from interfering with the biasing mechanism, a reservoir back panel 23 is placed thereover (FIG. 15). Thereafter the body cover 21 is located over the main body element 20, thereby forming a reservoir 40 therebetween. Cap 25 is hingedly mounted upon the rear of the main body element 20.

Figure 1:
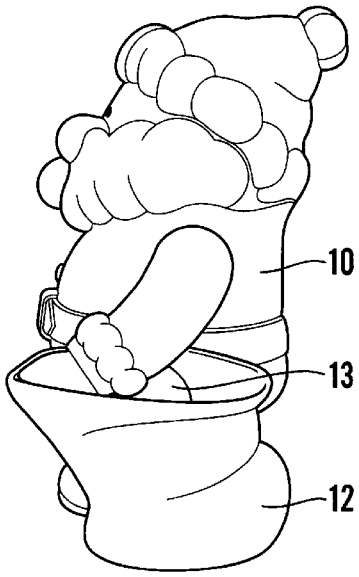
FIGS. 1 to 6 show, respectively, first side, second side, front, rear, front perspective and first side perspective views of a first embodiment of a dispenser in accordance with the present invention in a rest position.
Figure 2:
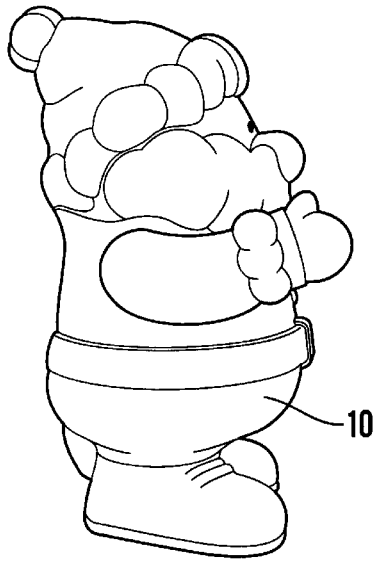
Figure 3:
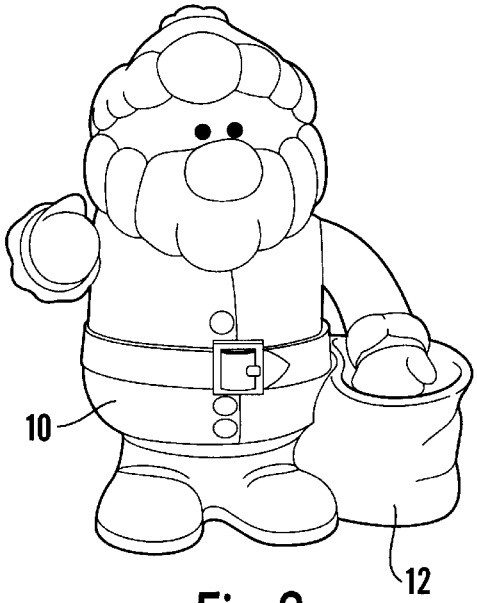
Figure 4:
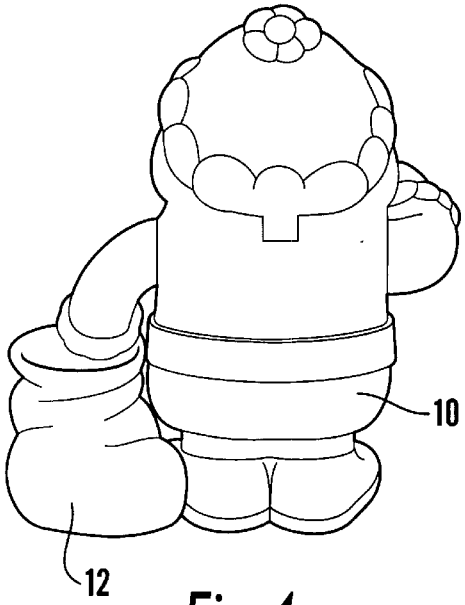
Figure 5:
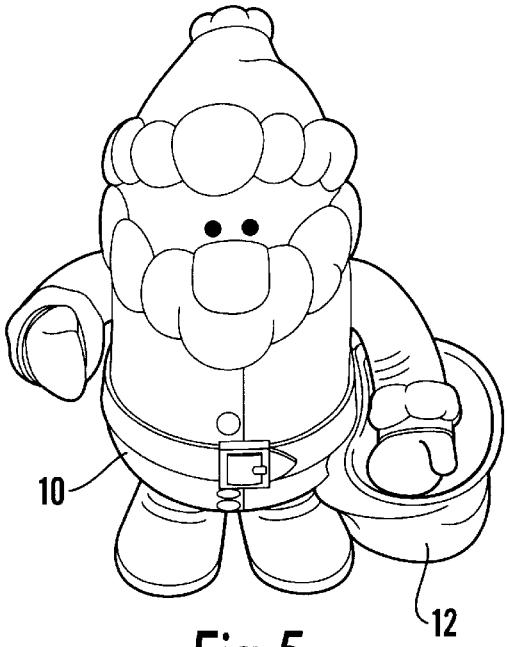
Figure 6:
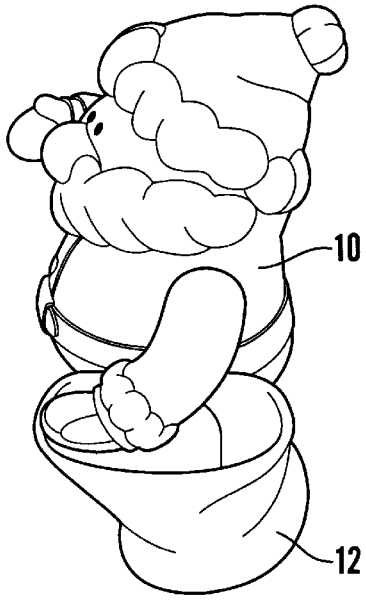
Figure 7:
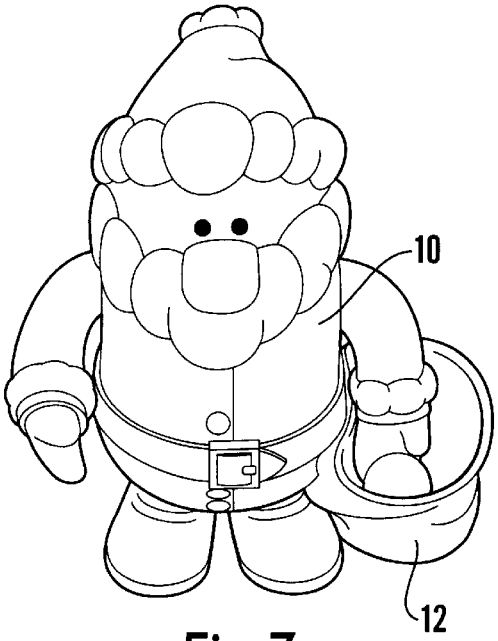
FIGS. 7 and 8 show, in front and first side perspective views, the embodiment of FIGS. 1 to 6 in a position whereby an article is dispensed.
Figure 8:
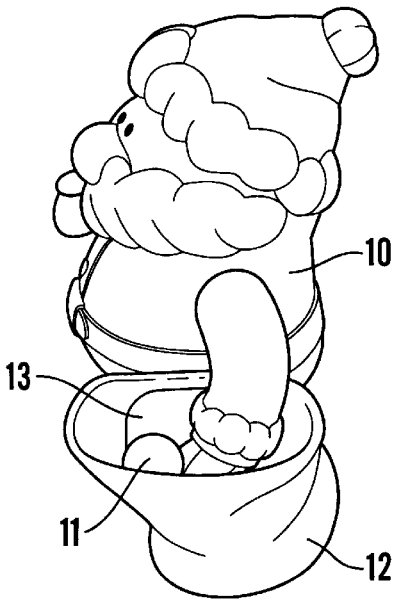
Figure 9:
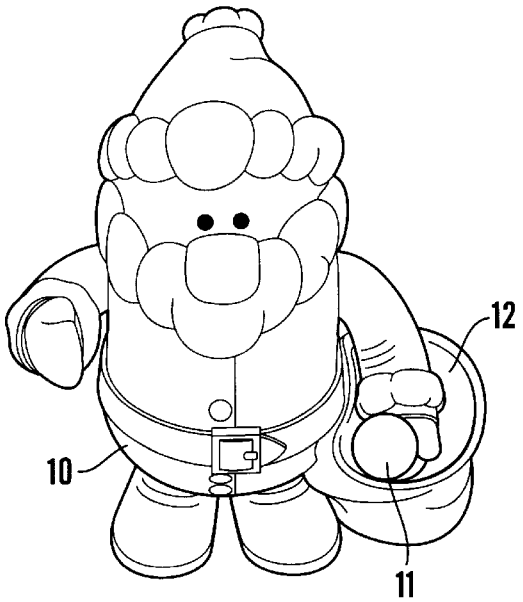
FIGS. 9 and 10 show, in front and first side perspective views, the embodiment of FIGS. 1 to 6 returned to the rest position whereby the dispensed article is lifted from the receptacle.
Figure 10:
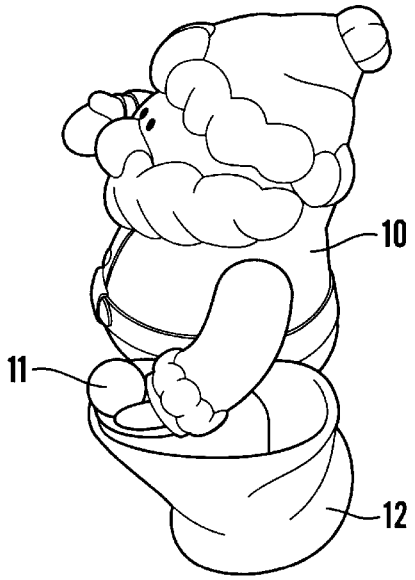
Figure 11:
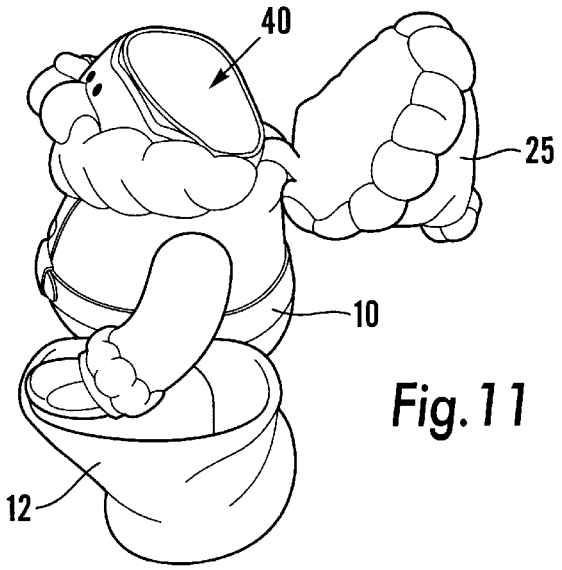
FIG. 11 is a first side perspective view illustrating the means by which the reservoir for articles to be dispensed is filled.

Operation of the dispenser will now be described in further detail. From the rest position (FIGS. 1–6) wherein the outlet 13 is obstructed by the paddle-shaped blade 33, Santa's right arm is lowered, by approximately 45–60° (FIGS. 7 & 8). This causes the blade 33 to away from obstruction of the outlet 13, allowing a sweet 11 to fall into the bag receptacle 12 (FIGS. 7 & 8). The spring 35 causes the rod 32 to return to the rest position thereby also returning Santa's left arm to an elevated position, scooping the sweet 11 out of the bag and presenting it to the user FIGS. 9 & 10).

Alternative mechanisms will be readily apparent to those skilled in the art. For example, the blade act upon a door constrained to move with a linear motion to release the sweet into the bag. The actuating mechanism may be actuated by means of a push- or lever-action upon the head of the dispenser. In a further embodiment, not shown, the dispenser also has the form of a human or animal body with at least one hollow limb. The actuating mechanism serves to lift and push the sweet or other article down the limb where it comes to rest in the bag or directly upon the hand of the dispenser.

The present invention is not, of course, restricted to dispensers in the form of Father Christmas. The principles are readily adaptable to many other designs or figures such as snowmen or penguins, both for Christmas and other festivals or events, for example an Easter Bunny or as tourist souvenirs.

What is claimed is:

1. A dispenser for small articles such as sweets, the dispenser comprising a body providing a reservoir for articles to be dispensed through an outlet formed therein, the dispenser comprising an actuator adapted to cause movement of a movable gate thereby allowing articles to pass through the outlet in response to an action from a user of the dispenser upon the actuator; wherein the actuator comprises at least one pivotable blade within the reservoir and adjacent the outlet.

2. A dispenser as claimed in claim 1 wherein the blade is pivotable to swing between a first position in which the blade obstructs the outlet and a second position in which the outlet is unobstructed.

3. A dispenser as claimed in claim 1 wherein the blade slides between obstructing and non-obstructing positions.

4. A dispenser as claimed in any one of claims 1 to 3 further comprising a receptacle into which an article is dispensed.

5. A dispenser as claimed in claim 4 further comprising a scoop to lift an article dispensed into the receptacle in response to a movement of the actuator.

6. A dispenser as claimed in claim 2, wherein the actuator comprises a rod having an arm fixedly mounted at each end thereof and carrying said blade intermediate the two arms, wherein the rod is pivotally mounted within the body of the dispenser and positioned such that the blade is adjacent and obstructs the outlet.

7. A dispenser as claimed in claim 6 wherein the rod also carries a first peg adapted to receive and retain a first end of a spring, a second end of which spring is received and retained by a second peg formed in an internal surface of the body of the reservoir.

8. A dispenser as claimed in claim 6 wherein a second blade is provided upon the rod, axially spaced from the first blade and radially spaced therefrom.

* * * * *